US008105161B2

(12) United States Patent
Rasmussen

(10) Patent No.: US 8,105,161 B2
(45) Date of Patent: Jan. 31, 2012

(54) WAGERING GAME MACHINE WITH OLED TRANSMISSIVE LCD

(75) Inventor: James M. Rasmussen, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 327 days.

(21) Appl. No.: 12/373,815

(22) PCT Filed: Jul. 16, 2007

(86) PCT No.: PCT/US2007/016245

§ 371 (c)(1),
(2), (4) Date: Jan. 14, 2009

(87) PCT Pub. No.: WO2008/011049

PCT Pub. Date: Jan. 24, 2008

(65) Prior Publication Data

US 2009/0286589 A1 Nov. 19, 2009

Related U.S. Application Data

(60) Provisional application No. 60/807,519, filed on Jul. 17, 2006.

(51) Int. Cl.
*A63F 9/24* (2006.01)

(52) U.S. Cl. ..... 463/31; 463/16; 463/20; 463/30

(58) Field of Classification Search ..... 463/30, 463/16, 20, 31
See application file for complete search history.

(56) References Cited

U.S. PATENT DOCUMENTS

2002/0173354 A1* 11/2002 Winans et al. ..... 463/20
2002/0197511 A1* 12/2002 D'Andrade et al. ..... 428/690
2005/0153775 A1* 7/2005 Griswold et al. ..... 463/30
2005/0176493 A1 8/2005 Nozaki et al.
2005/0248270 A1* 11/2005 Ghosh et al. ..... 313/512

OTHER PUBLICATIONS

"International Application Serial No. PCT/US2007/016245, Search Report mailed May 28, 2008", 4 pgs.
"International Application Serial No. PCT/US2007/016245, Written Opinion mailed May 28, 2008", 5 pgs.

* cited by examiner

*Primary Examiner* — Omkar Deodhar
(74) *Attorney, Agent, or Firm* — Schwegman, Lundberg & Woessner, P.A.

(57) ABSTRACT

A computerized wagering game system includes a gaming module comprising a processor and gaming code which is operable when executed on the processor to present a wagering game on which monetary value can be wagered via at least one mechanical reel and a liquid crystal display (LCD). The liquid crystal display has at leas tone transparent portion through which the mechanical reel or reels can be observed. An organic light emitting diode (OLED) element is disposed near the transparent portion of the liquid crystal display, and is operable to selectively emit light or pass light, such that emitted light is passed through the transparent portion of the liquid crystal display when the OLED emits light or the at least one mechanical game object can be observed through the transparent portion of the liquid crystal display and the OLED when the OLED passes light.

27 Claims, 5 Drawing Sheets

WAGERING GAME MACHINE WITH OLED TRANSMISSIVE LCD

This patent application is a U.S. National Stage Filing under 35 U.S.C. 371 from International Patent Application Serial No. PCT/US2007/016245, filed Jul. 16, 2007, and published on Jan. 24, 2008 as WO 2008/011049 A2 and republished as WO 2008/011049 A3, which claims the benefit of the filing date of U.S. Provisional Patent Application Ser. No. 60/807,519, filed Jul. 17, 2006 entitled, "TRANSMISSIVE LCD WITH TRANSPARENT OLED IN A WAGERING GAME MACHINE," which priority is hereby claimed under 35 U.S.C. §119(e) and the entire content of which is incorporated herein by reference.

FIELD OF THE INVENTION

The invention relates generally to computerized wagering game machines, and more specifically to transmissive lcd panels in computerized wagering game machines.

LIMITED COPYRIGHT WAIVER

A portion of the disclosure of this patent document contains material to which the claim of copyright protection is made. The copyright owner has no objection to the facsimile reproduction by any person of the patent document or the patent disclosure, as it appears in the U.S. Patent and Trademark Office file or records, but reserves all other rights whatsoever. Copyright 2006, WMS Gaming, Inc.

BACKGROUND

Computerized wagering games have largely replaced traditional mechanical wagering game machines such as slot machines, and are rapidly being adopted to implement computerized versions of games that are traditionally played live such as poker and blackjack. These computerized games provide many benefits to the game owner and to the gambler, including greater reliability than can be achieved with a mechanical game or human dealer, more variety, sound, and animation in presentation of a game, and a lower overall cost of production and management.

The elements of computerized wagering game systems are in many ways the same as the elements in the mechanical and table game counterparts in that they must be fair, they must provide sufficient feedback to the game player to make the game fun to play, and they must meet a variety of gaming regulations to ensure that both the machine owner and gamer are honest and fairly treated in implementing the game. Further, they must provide a gaming experience that is at least as attractive as the older mechanical gaming machine experience to the gamer, to ensure success in a competitive gaming market.

Computerized wagering games do not rely on the dealer or other game players to facilitate game play and to provide an entertaining game playing environment, but rely upon the presentation of the game and environment generated by the wagering game machine itself. Incorporation of audio and video features into wagering games to present the wagering game, to provide help, and to enhance the environment presented are therefore important elements in the attractiveness and commercial success of a computerized wagering game system. It is not uncommon for audio voices to provide instruction and help, and to provide commentary on the wagering game being played. Music and environmental effects are also played through speakers in some wagering game systems to enhance or complement a theme of the wagering game. These sounds typically accompany video presentation of the wagering game on a screen, which itself often includes animation, video, and three-dimensional graphics as part of presentation of the wagering game.

But, many people prefer to see mechanical reels rather than video rendering of a slot machine game, in part due to the more traditional appearance of the rotating slot reels. Presentation of mechanical reels makes the wagering game more enjoyable for some of these people, and so mechanical reel slot machines are still common in many wagering game facilities. But, use of reel slot machines limits the ability of a wagering game machine to present computer graphics and animation to enhance the theme of the wagering game or to provide other information, and so are often less entertaining than LCD (liquid crystal display) touchscreen wagering game systems.

It is therefore desired that the advantages of LCD displays be incorporated into wagering games having mechanical elements such as reel slot machines.

SUMMARY

One example embodiment of the invention comprises a computerized wagering game system includes a gaming module comprising a processor and gaming code which is operable when executed on the processor to present a wagering game on which monetary value can be wagered via at least one mechanical reel and a liquid crystal display (LCD). The liquid crystal display has at least one transparent portion through which the mechanical reel or reels can be observed. An organic light emitting diode element is disposed near the transparent portion of the liquid crystal display, and is operable to selectively emit light or pass light, such that emitted light is passed through the transparent portion of the liquid crystal display when the organic light emitting diode emits light or the at least one mechanical game object can be observed through the transparent portion of the liquid crystal display and the organic light emitting diode when the organic light emitting diode passes light.

DETAILED DESCRIPTION

In the following detailed description of example embodiments of the invention, reference is made to specific examples by way of drawings and illustrations. These examples are described in sufficient detail to enable those skilled in the art to practice the invention, and serve to illustrate how the invention may be applied to various purposes or embodiments.

Other embodiments of the invention exist and are within the scope of the invention, and logical, mechanical, electrical, and other changes may be made without departing from the scope or extent of the present invention. Features or limitations of various embodiments of the invention described herein, however essential to the example embodiments in which they are incorporated, do not limit the invention as a whole, and any reference to the invention, its elements, operation, and application do not limit the invention as a whole but serve only to define these example embodiments. The following detailed description does not, therefore, limit the scope of the invention, which is defined only by the appended claims.

One example embodiment of the invention comprises a computerized wagering game system includes a gaming module comprising a processor and gaming code which is operable when executed on the processor to present a wagering game on which monetary value can be wagered via at least one mechanical reel and a liquid crystal display (LCD). The liquid crystal display has at least one transparent portion through which the mechanical reel or reels can be observed. An organic light emitting diode element is disposed near the transparent portion of the liquid crystal display, and is operable to selectively emit light or pass light, such that emitted light is passed through the transparent portion of the liquid crystal display when the organic light emitting diode emits light or the at least one mechanical game object can be observed through the transparent portion of the liquid crystal display and the organic light emitting diode when the organic light emitting diode passes light.

Figure 1:
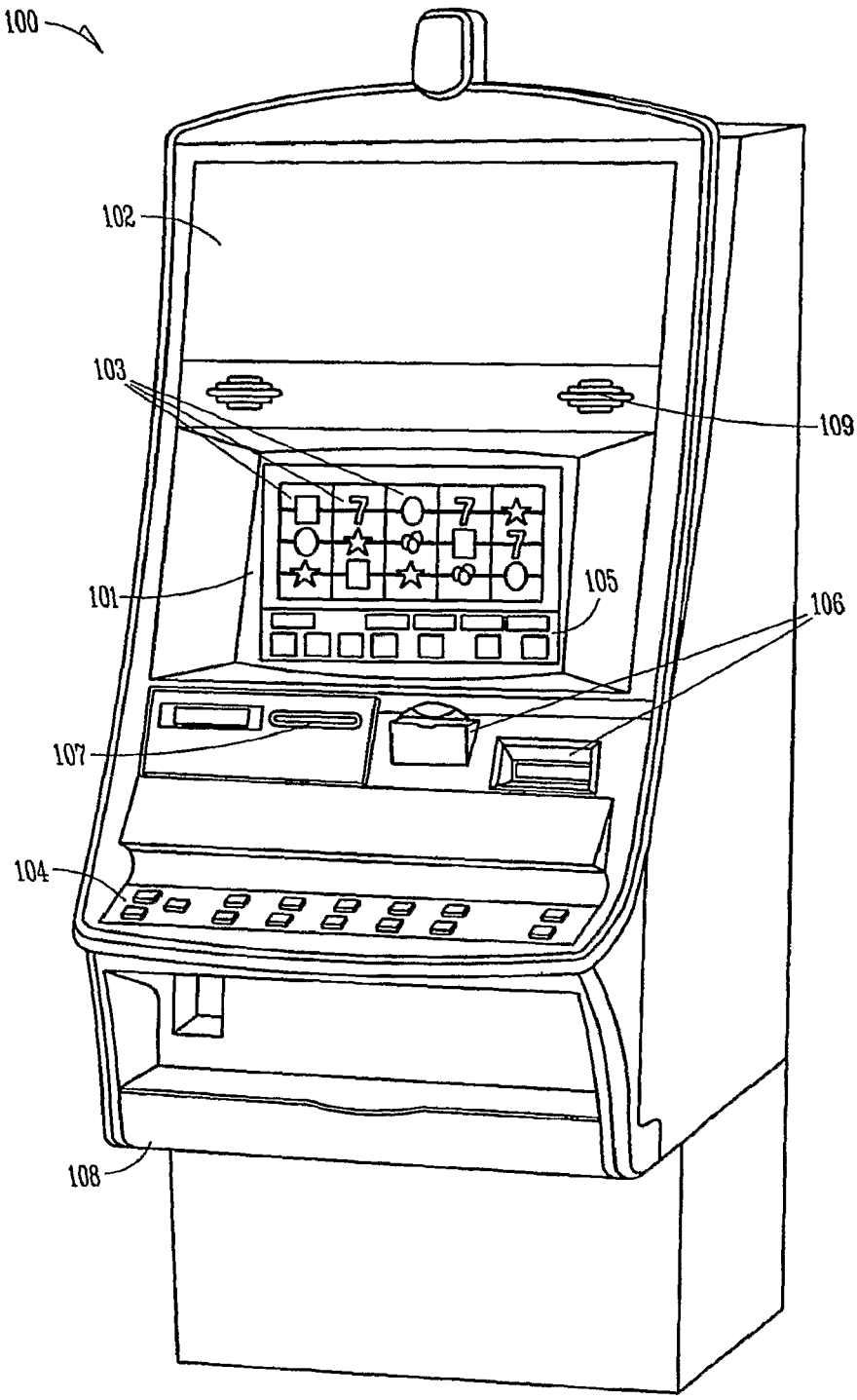
FIG. 1 shows a computerized wagering game machine, as may be used to practice some example embodiments of the invention.

FIG. 1 illustrates a computerized wagering game machine, as may be used to practice some embodiments of the present invention. The computerized gaming system shown generally at 100 is a video wagering game system, which displays information for at least one wagering game upon which monetary value can be wagered on video display 101. A first video display 101 is in various embodiments a CRT display, a plasma display, an LCD display, a surface conducting electron emitter display, or any other type of display suitable for displaying electronically provided display information. In some further embodiments, additional displays such as a bonus game display or top box display 102 are further operable to display electronically provided information to a wagering game player. Alternate embodiments of the invention will have other game indicators, such as mechanical reels instead of the video graphics reels shown at 103 that comprise a part of a video slot machine wagering game.

A wagering game is implemented using software within the wagering game machine, such as through instructions stored on a machine-readable medium such as a hard disk drive or nonvolatile memory. In some further example embodiments, some or all of the software stored in the wagering game machine is encrypted or is verified using a hash algorithm or encryption algorithm to ensure its authenticity and to verify that it has not been altered. For example, in one embodiment the wagering game software is loaded from nonvolatile memory in a compact flash card, and a hash value is calculated or a digital signature is derived to confirm that the data stored on the compact flash card has not been altered. The game of chance implemented via the loaded software takes various forms in different wagering game machines, including such well-known wagering games as reel slots, video poker, blackjack, craps, roulette, or hold 'em games. In some further embodiments, a secondary game or bonus game is displayed on the secondary display 102, or other information such as progressive slot information or other community game information is displayed.

The wagering game is played and controlled with inputs such as various buttons 104 or via a touchscreen overlay to video screen 101. The touchscreen is used in some embodiments to display virtual buttons, which can have unique functions in some embodiments, or can duplicate the functions provided by the mechanical buttons 104 in other embodiments. In some alternate examples, other devices such as a pull arm are used to initiate reel spin in this reel slot machine example are employed to provide other input interfaces to the game player. The player interface components are in this example contained within or mechanically coupled to the wagering game system, but in other embodiments will be located outside the wagering game system cabinet such as by a wired or wireless electronic connection to the wagering game system.

Monetary value is typically wagered on the outcome of the games, such as with tokens, coins, bills, or cards that hold monetary value. The wagered value is conveyed to the machine such as through a changer 106 or a secure user identification module interface 107, and winnings are returned such as via a returned value ticket, a stored value card, or through the coin tray 108. Sound is also provided through speakers 109, typically including audio indicators of game play, such as reel spins, credit bang-ups, and environmental or other sound effects or music to provide entertainment consistent with a theme of the computerized wagering game. In some further embodiments, the wagering game machine is coupled to a network, and is operable to use its network connection to receive wagering game data, track players and monetary value associated with a player, and to perform other such functions.

In other embodiments, the computerized wagering game system takes one or more other forms, such as a mobile or portable wagering game device, a server-based wagering game device, or a networked wagering game system. These other computerized wagering game system embodiments need not contain all features of the wagering game system of FIG. 1, which does not limit the scope of a computerized wagering game but is provided as an example only.

Figure 2:
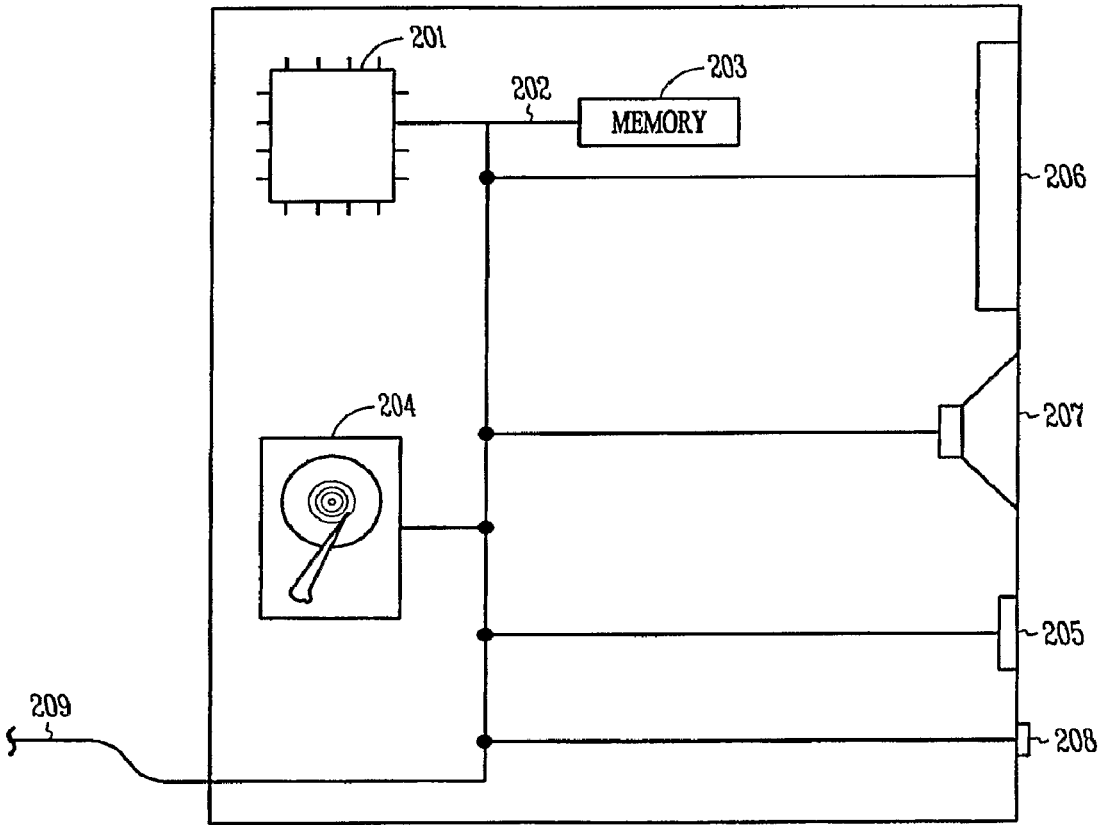
FIG. 2 is a block diagram of a computerized wagering game machine, consistent with some example embodiments of the invention.

FIG. 2 shows a block diagram of an example embodiment of a wagering game system. The wagering game system includes a processor 201, which is sometimes called a microprocessor, controller, or central processing unit (CPU). In some embodiments, more than one processor is present, or different types of processors are present in the wagering game system, such as using multiple processors to run gaming code, or using dedicated processors for audio, graphics, security, or other functions. The processor is coupled via a bus 202 to various other components, including memory 203 and nonvolatile storage 204. The nonvolatile storage is able to retain the data stored therein when power is removed, and in various embodiments takes the form of a hard disk drive, nonvolatile random access memory such as a compact flash card, or network-coupled storage. Further embodiments include additional data storage technologies, such as compact disc, DVD, or HD-DVD storage in the wagering game system.

The bus 202 also couples the processor and components to various other components, such as a value acceptor 205, which is in some embodiments a token acceptor, a card reader, or a biometric or wireless player identification reader. A touchscreen display 206 and speakers 207 serve to provide an interface between the wagering game system and a wagering game player, as do various other components such as buttons 208, pullarms, and joysticks. A network connection 209 couples the wagering game system in some embodiments to other wagering game systems, a wagering game server, or other network devices. These components are located in a wagering game machine cabinet such as that of FIG. 1 in some embodiments, but can be located in multiple enclosures comprising a wagering game system or outside a wagering game machine cabinet in other embodiments, or in alternate forms such as a wireless or mobile device.

In operation, the wagering game system loads program code from nonvolatile storage 204 into memory 203, and the processor 201 executes the program code to cause the wagering game system to perform desired functions such as to present a wagering game upon which monetary value can be wagered. This and other functions are provided by various modules in the computerized system such as an audio module, a game presentation module, or a touchscreen display module, where such modules comprise in some embodiments hardware, software, mechanical elements, manual intervention, and various combinations thereof.

Figure 3:
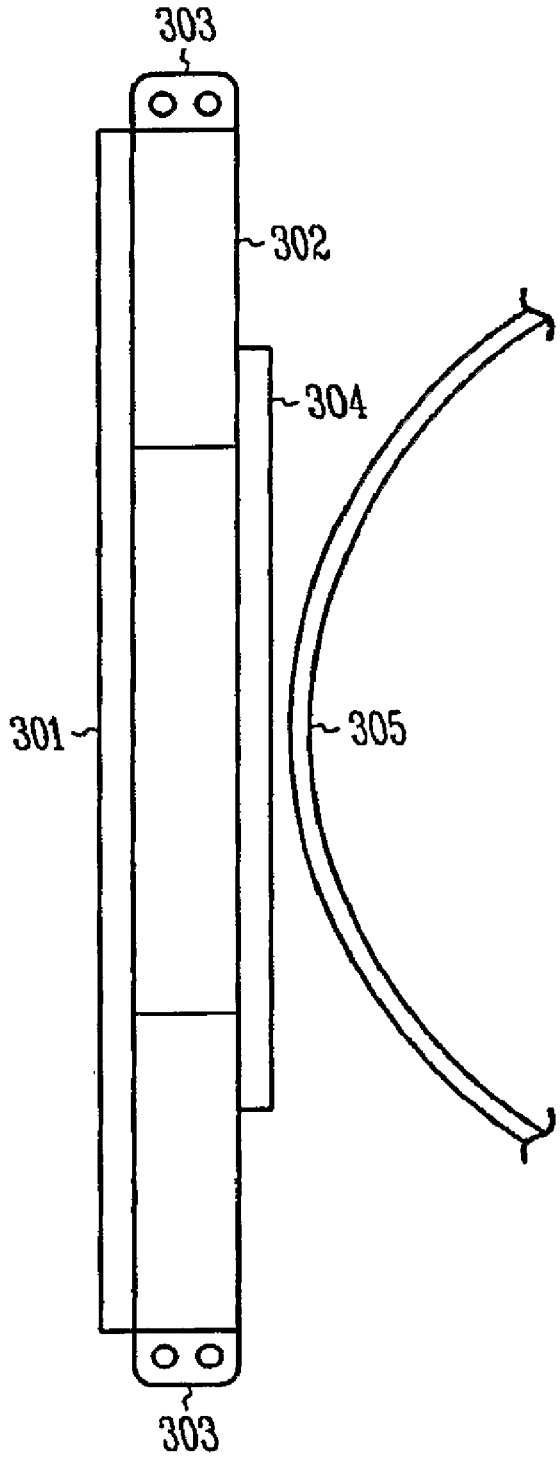
FIG. 3 shows a side view of a mechanical reel video slot machine, consistent with some example embodiments of the invention.

The liquid crystal display panel and mechanical reel are shown in a more detailed view in FIG. 3. The touchscreen liquid crystal display (LCD) panel 301 comprises several layers, including an illumination layer 302 and a back reflective layer that are removed in the transmissive region of the liquid crystal display assembly. The portion of the liquid crystal display having the illumination layer 302 and the reflective layer removed is protected by a dust cover 304. Because the back reflective layer and illumination layer are from the LCD panel assembly in a region as shown in FIG. 3, the front face of the slot machine reel 305 can be easily seen through the LCD panel.

The LCD panel remains operational in this region, and is able to superimpose graphics over the reels visible behind the LCD panel. Each pixel in a typical LCD panel comprises a liquid crystal suspended between two polarizing filters with axes that are perpendicular to each other. In the absence of the liquid crystal presence, light passing through one polarized filter would not be able to pass through the other due to the difference in polarization direction. The liquid crystal element changes the polarization of light that has passed through the first polarizing filter so that its polarization has changed and it can pass through the second polarizing filter.

When an electrical charge is applied to a liquid crystal element in a liquid crystal display pixel, the natural twist of the liquid crystal is undone to a degree dependent on the charge applied as the liquid crystals align themselves parallel to the electric field, thereby reducing the change in polarization by a varying amount and blocking light from passing through both the first and second polarizing filters to a variable degree.

While some LCD displays such as those used in pocket calculators and wristwatches are simply reflective, and use ambient light reflected off a reflective backplane, most are transmissive panels that are lit via one or more backlights, such as are commonly found in LCD computer monitors and cellular telephones. These transmissive LCD panels rely on backlighting, which is usually provided by lamps such as 303 and distributed across the face of the liquid crystal display panel by a light carrying layer called a diffusion layer such as illumination layer 302 that carries and diffuses light injected from the sides of the panel to ensure uniform illumination of the transmissive LCD panel. This principle can be used to create a color display by using a red, green, and blue subpixel for each pixel location, so that a full color spectrum can be displayed for each pixel by varying the amount of these three light primary colors that is visible. This is done by varying the voltages applied to each of the three colored subpixels, thereby varying the amount of colored light from the backlight diffuser layer of the display panel that reaches the viewer.

The back side of the liquid crystal display panel is therefore almost always an opaque surface designed to reflect light, to illuminate the display pane. In some embodiments of the invention such as are shown in FIG. 3, the back reflective coating is removed from a portion of the LCD display panel, allowing light to pass through the panel when the LCD elements are not energized. As FIG. 3 shows, a mechanical element such as a slot machine reel 305 placed behind the LCD display panel is then visible, resulting in a display that allows presentation of both computer graphics or video and of a mechanical element located behind the portion of the LCD display panel that lacks a reflective backing.

The slot machine display assembly of FIG. 3 includes a transparent material such as polycarbonate, acrylic, or glass to shield the back side of the transmissive portion of the liquid crystal display panel from being scratched by contact with other objects, or from accumulating dust. This dust shield can therefore discolor or turn yellow over time if certain plastics are used, and can induce glare, block some portion of the light, and introduce parallax to a game player viewing the mechanical reel 305 through the transmissive liquid crystal display assembly.

Further, the light distributed in illumination layer or diffusion layer 302 is either blocked by the transmissive portion of the liquid crystal display, or emits light into the gap between the liquid crystal display 301 and the dust shield 304. Because the reel 305 is placed back from the illumination layer 305 and is separated from the illumination layer by the dust shield, relatively little light from the illumination layer 302 is able to illuminate the slot machine mechanical reel 305. A principle of optics known as Snell's law indicates that if light strikes a transmissive medium such as dust shield 304 at an angle nearly parallel enough to the surface of the transmissive medium, the light is reflected and not transmitted through the medium. Although the total reflection angle is dependent on the relative index of refraction of the medium, the configuration of FIG. 3 is not likely to pass significant light from the illumination layer 302 through the dust shield 304 to illuminate the reel 305.

Figure 4:
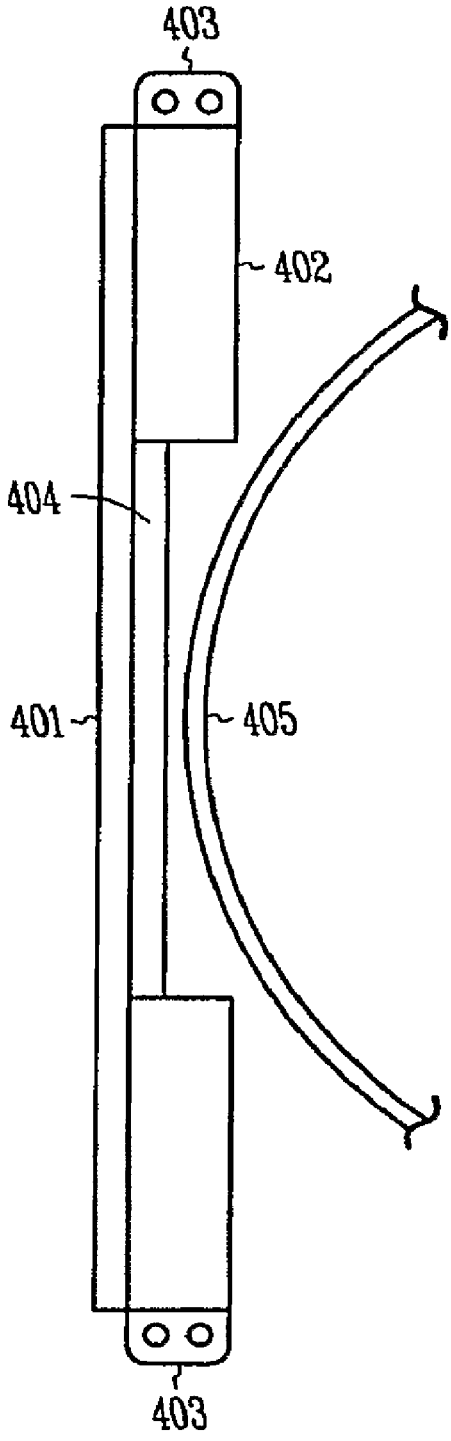
FIG. 4 shows a side view of an alternate mechanical reel video slot machine configuration, consistent with some example embodiments of the invention.

FIG. 4 shows a transmissive liquid crystal display panel including a transparent organic light emitting diode, consistent with some example embodiments of the invention. A liquid crystal display panel 401 is backed by a light diffusion layer 402, which carries light from backlights 403 to backlight the liquid crystal display panel. In the transmissive portion of the liquid crystal display, an organic light emitting diode panel 404 backs the liquid crystal display panel, and is operable to selectively provide light or remain off and in a transparent or substantially transparent state.

The lights 403 are in some embodiments cold cathode fluorescent lamps, or are in other embodiments other types of lamp capable of producing light and directing the light toward the light diffusion layer 402. In this example, the diffusion layer simply stops when it reaches the transmissive portion of the liquid crystal display, but in other embodiments will be blacked out at the edges to prevent light from the diffusion layer from reaching the transmissive portion of the liquid crystal display, or will be contoured to direct light in certain directions such as onto mechanical reel assembly 405. In a still further example, the reel assembly 405 itself includes a backlight, operable to selectively illuminate the reel and the reel symbols imprinted thereon.

The organic light emitting diode layer 404 serves to protect the back side of the liquid crystal display, eliminating the need for a further dust shield. In operation, the organic light emitting diode is switched on when a full-screen image is displayed across the liquid crystal display, and produces a bright white light that is in some embodiments matched in amplitude, color temperature, or other characteristics to the backlight provided by lamps 403 and diffusion layer 402 to provide an even illumination of the liquid crystal display and provide a relatively seamless image presentation to the game player. The backlight is activated by application of an electric voltage, and is deactivated by removing the electric actuation voltage from the organic light emitting diode. When the organic light emitting diode is off, it is desirably transparent, or at least substantially transparent, so that the reel symbols on reel 405 can be easily seen. In various further embodiments, various lighting configurations such as lamps, light pipes, backlighting, or other lighting configurations are also used to illuminate the reel strip.

A further benefit of the configuration of FIG. 4 is the relative proximity of the reel strip to the front of the liquid crystal display. This not only makes the mechanical slot machine reel easier to see, but it brings it closer to ambient light around the wagering game machine, potentially reducing the extra illumination needed to ensure that the reel strip is sufficiently well lit to be clearly visible at selected times.

Figure 5:
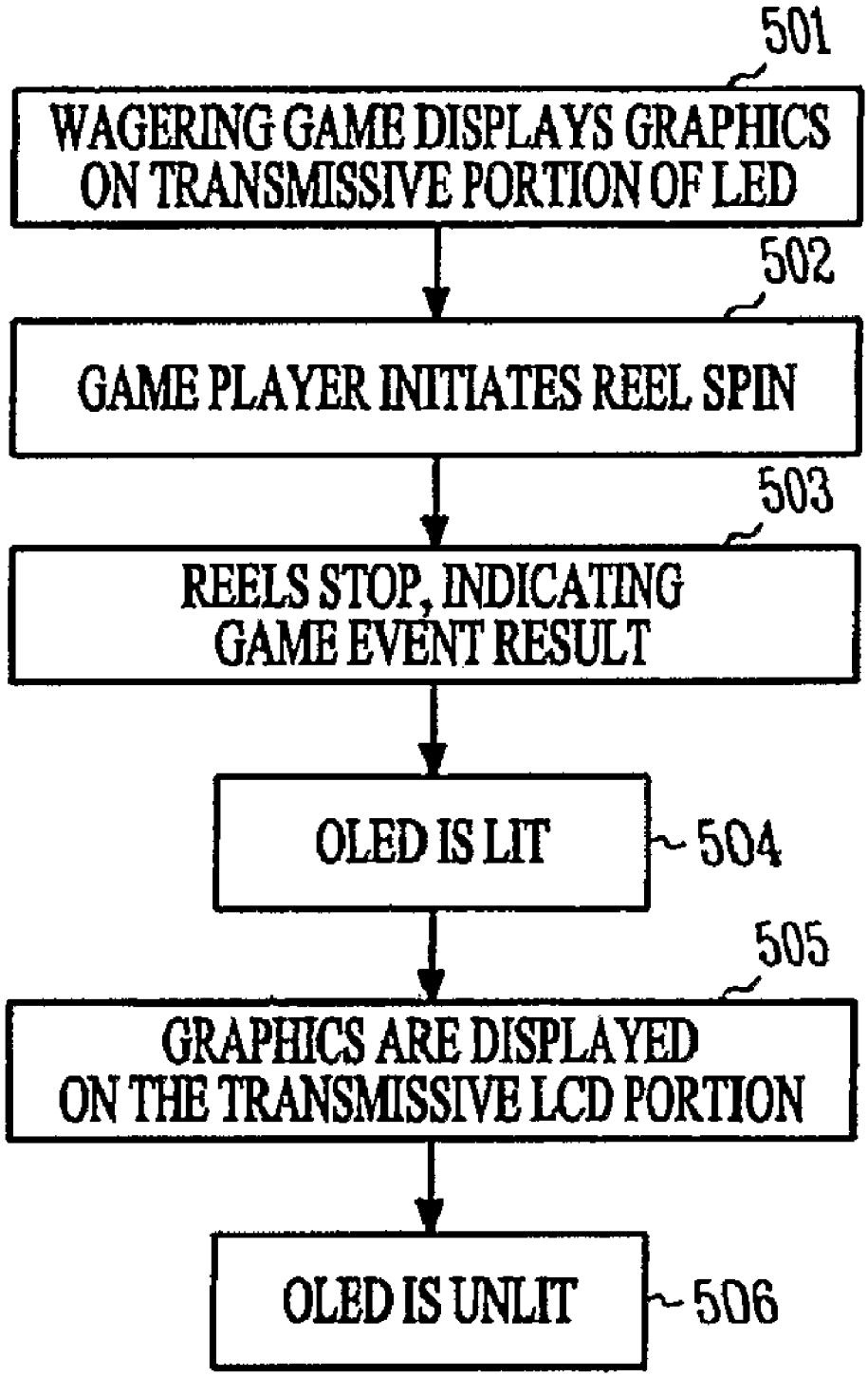
FIG. 5 shows a flowchart illustrating an example method of practicing one embodiment of the invention example embodiment of the invention.

Use of an organic light emitting diode to selectively backlight a transparent portion of a liquid crystal display during wagering game play in a mechanical reel slot machine is described in greater detail with reference to the flowchart of FIG. 5. At 501, the wagering game system displays graphics on the transmissive portion of the liquid crystal display, such as graphics related to a theme of the wagering game, or animations, accumulated credits, video, instructions, or other such graphics. The graphics may or may not be displayed, and the slot reels may or may not be lit and visible when the wagering game player initiates a round of game play by starting a reel spin of the slot machine at 502. Once the reels are spun, the organic light emitting diode is unlit if it is lit. The reels spin and stop sequentially at determined locations, indicating a result of the game event at 503, and because the reels are lit and the organic light emitting diode is not lit, the reels are visible to the wagering game player through the transparent portion of the liquid crystal display.

At 504, organic light emitting diode is lit, and screens the reels from the transparent portion of the liquid crystal display. This also backlights the transmissive portion of the liquid crystal display, so that graphics can be shown on the transmissive portion of the display such that they form a visually continuous image with the portion of the backlit display illuminated by diffusion layer 402 and lamps 403 of FIG. 4.

Graphics are then displayed on the liquid crystal display screen at 505, extending across the transparent and opaque portions of the display. The backlighting effect of the organic light emitting diode can again be controlled such that the backlighting provided to the transparent portion of the liquid crystal display is similar to that provided internally to the opaque portions of the liquid crystal display, so that graphics displayed across the opaque and transparent portions of the display appear relatively uniform in brightness and contrast.

At 506, the organic light emitting diode is unlit, so that the reels are once again not screened, and graphics are shown on the opaque portion of the liquid crystal display such that the reels are illuminated and ready for another round of game play at 502. In an alternate embodiment, graphics are displayed on the transparent portion of the liquid crystal display even when the reels are visible, and can be used for various purposes such as to highlight certain reel symbols or accentuate certain paylines indicating a sequence of winning reel symbols.

The examples given here show how an organic light emitting diode can be used in a wagering game having a liquid crystal display with a transparent portion to selectively backlight the liquid crystal display or permit viewing of an object through the transparent portion of the display. Although certain examples shown and described here, other blocking elements and other variations exist and are within the scope of the invention. It will be appreciated by those of ordinary skill in the art that any arrangement which is calculated to achieve the same purpose may be substituted for the specific embodiments shown. This application is intended to cover any adaptations or variations of the example embodiments of the invention described herein. It is intended that this invention be limited only by the claims, and the full scope of equivalents thereof.

The invention claimed is:

1. A computerized wagering game system, comprising:

a gaming module comprising a processor and gaming code which is operable when executed on the processor to present a wagering game on which monetary value can be wagered;

a liquid crystal display (LCD) having at least one transparent portion through which at least one object can be observed, as well as an opaque portion; and an organic light emitting diode disposed between the at least one object and the at least one transparent portion of the liquid crystal display, and operable to selectively emit light or not emit light, such that the emitted light is passed through the at least one transparent portion of the liquid crystal display when the organic light emitting diode emits the light and game graphics displayed across the at least one transparent portion and the opaque portion of the LCD appear relatively uniform when the organic light emitting diode emits the light, and the at least one object can be observed through the at least one transparent portion of the liquid crystal display and the organic light emitting diode when the organic light emitting diode does not emit the light.

2. The computerized wagering game system of claim 1, wherein the organic light emitting diode changes between emitting light and not emitting light in response to application of a voltage signal.

3. The computerized wagering game system of claim 1, wherein the at least one object is a mechanical reel slot machine symbol reel.

4. The computerized wagering game system of claim 3, further comprising at least one light configured to selectively illuminate the mechanical reel slot machine symbol reel.

5. The computerized wagering game system of claim 1, wherein the organic light emitting diode serves as a dust shield for the at least one transparent portion of the liquid crystal display.

6. The computerized wagering game system of claim 1, wherein the organic light emitting diode comprises a polymer.

7. The computerized wagering game system of claim 1, wherein the organic light emitting diode comprises a monochromatic white organic light emitting diode.

8. The computerized wagering game system of claim 1, wherein at least a portion of the at least one object is disposed within the plane of the liquid crystal display and near the at least one transparent portion of the liquid crystal display.

9. A method of operating a computerized wagering game system, comprising:

presenting a wagering game on which monetary value can be wagered;

displaying an image on a liquid crystal display (LCD) having at least one transparent portion through which at least one object can be observed, as well as an opaque portion; and selectively lighting an organic light emitting diode disposed between the at least one object and the at least one transparent portion of the liquid crystal display and operable to selectively emit light or not emit light, such that emitted light is passed through the at least one transparent portion of the liquid crystal display when the organic light emitting diode emits the light and game graphics displayed across the at least one tranparent portion and the opaque portion of the LCD appear relatively uniform when the organic light emitting diode emits the light, and the at least one object can be observed through the at least one transparent portion of the liquid crystal display and the organic light emitting diode when the organic light emitting diode does not emit the light.

10. The method of operating a computerized wagering game system of claim 9, wherein the organic light emitting diode changes between emitting light and not emitting light in response to application of a voltage signal.

11. The method of operating a computerized wagering game system of claim 9, wherein the at least one object is a mechanical reel slot machine symbol reel.

12. The method of operating a computerized wagering game system of claim 11, further comprising selectively illuminating at least one light configured to illuminate the mechanical reel slot machine symbol reel.

13. The method of operating a computerized wagering game system of claim 9, wherein the organic light emitting diode serves as a dust shield for the at least one transparent portion of the liquid crystal display.

14. The method of operating a computerized wagering game system of claim 9, wherein the organic light emitting diode comprises a polymer.

15. The method of operating a computerized wagering game system of claim 9, wherein the organic light emitting diode comprises a monochromatic white organic light emitting diode.

16. The method of operating a computerized wagering game system of claim 9, wherein at least a portion of the object is disposed within the plane of the liquid crystal display and near the at least one transparent portion of the liquid crystal display.

17. A display panel apparatus, comprising:

a liquid crystal display (LCD) having at least one transparent portion through which an object can be observed, as well as an opaque portion; and an organic light emitting diode disposed between the object and the at least one transparent portion of the liquid crystal display and operable to selectively emit light or not emit light, such that emitted light is passed through the at least one transparent portion of the liquid crystal display when the organic light emitting diode emits the light and game graphics displayed across the at least one transparent portion and the opaque portion of the LCD appear relatively uniform when the organic light emitting diode emits the light, and the object can be observed through the at least one transparent portion of the liquid crystal display and the organic light emitting diode when the organic light emitting diode does not emit the light.

18. The display panel apparatus of claim 17, wherein the organic light emitting diode changes between emitting light and not emitting light in response to application of a voltage signal.

19. The display panel apparatus of claim 17, wherein the organic light emitting diode serves as a dust shield for the at least one transparent portion of the liquid crystal display.

20. The display panel apparatus of claim 17, wherein the organic light emitting diode comprises a polymer.

21. The display panel apparatus of claim 17, wherein the organic light emitting diode comprises a monochromatic white organic light emitting diode.

22. The display panel apparatus of claim 17, wherein at least a portion of the object is disposed within the plane of the liquid crystal display and near the at least one transparent portion of the liquid crystal display.

23. A computerized wagering game system, comprising:

at least one object for presenting a wagering game event;

a liquid crystal display (LCD) having at least one transmissive portion positioned in front of the at least one object, as well as an opaque portion; and an organic light emitting diode (OLED) element positioned between the at least one object and the at least one transmissive portion of the LCD, the OLED element being selectively operable to emit light or not emit light, wherein in response to the OLED element emitting light, the emitted light passes through the at least one transmissive portion of the LCD to illuminate game graphics displayed thereon and obscure the at least one object, and the game graphics displayed across the at least one transmissive portion and the opaque portion of the LCD appear relatively uniform, and wherein response to the OLED element not emitting light, the at least one object can be observed through the at least one transmissive portion of the LCD.

24. The computerized wagering game system of claim 23, whererin in response to the OLED element emitting light, the game graphics on the at least one transmissive portion of the LCD form a visually continuous image with graphics on a remainder of the LCD.

25. The computerized wagering game system of claim 23, wherein in response to the OLED element emitting light, the game graphics displayed across the at least one transmissive portion of the LCD and a remainder of the LCD appear relatively uniform.

26. The computerized wagering game system of claim 23, wherein the at least one object includes a symbol-bearing reel.

27. The computerized wagering game system of claim 23, wherein the LCD includes an LCD panel backed by a diffusion layer in the opaque portion and backed by the OLED element in the at least one transmissive portion, the LCD including a backlight directing light toward the diffusion layer.

* * * * *

UNITED STATES PATENT AND TRADEMARK OFFICE

CERTIFICATE OF CORRECTION

PATENT NO. : 8,105,161 B2
APPLICATION NO. : 12/373815
DATED : January 31, 2012
INVENTOR(S) : James M. Rasmussen It is certified that error appears in the above-identified patent and that said Letters Patent is hereby corrected as shown below:

On the face page, in field (57), under "Abstract", in column 2, line 6, delete "leas" and insert -- least one --, therefor.

In column 5, lines 62-67 and in column 6, lines 1-3, delete "This principle can be used to create a color display by using a red, green, and blue subpixel for each pixel location, so that a full color spectrum can be displayed for each pixel by varying the amount of these three light primary colors that is visible. This is done by varying the voltages applied to each of the three colored subpixels, thereby varying the amount of colored light from the backlight diffuser layer of the display panel that reaches the viewer." and insert the same after "panel." on Col. 5, Line 63 as new paragraph.

In column 9, line 11, in Claim 9, delete "that" and insert -- that the --, therefor.

In column 9, line 14, in Claim 9, delete "tranparent" and insert -- transparent --, therefor.

In column 9, line 56, in Claim 17, delete "that" and insert -- that the --, therefor.

In column 10, line 37, in Claim 23, delete "wherein" and insert -- wherein in --, therefor.

In column 10, line 42, in Claim 24, delete "whererin" and insert -- wherein --, therefor.

Signed and Sealed this
Seventeenth Day of April, 2012

David J. Kappos

David J. Kappos
*Director of the United States Patent and Trademark Office*